United States Patent [19]

Patalon

[11] Patent Number: 4,629,418

[45] Date of Patent: Dec. 16, 1986

[54] PROCESS AND FURNACE FOR REHEATING METALLIC OBJECTS

[75] Inventor: Heinrich Patalon, Bochum, Fed. Rep. of Germany

[73] Assignee: Didier Engineering GmbH, Essen, Fed. Rep. of Germany

[21] Appl. No.: 785,777

[22] Filed: Oct. 9, 1985

[30] Foreign Application Priority Data

Nov. 2, 1984 [DE] Fed. Rep. of Germany ..... 3440048

[51] Int. Cl.[4] ..... F27D 3/00; C21B 1/00; F27B 9/00

[52] U.S. Cl. ..... 432/11; 266/249; 432/144; 432/149

[58] Field of Search ..... 432/11, 121, 122, 124, 432/144, 149; 266/249, 261

[56] References Cited

U.S. PATENT DOCUMENTS 3,540,706 11/1970 Wilt, Jr. ..... 432/124

4,025,298 5/1977 Tokitsu ..... 432/122

4,478,573 10/1984 Kitayama et al. ..... 432/11

*Primary Examiner*—John J. Camby

*Attorney, Agent, or Firm*—Peter K. Kontler

[57] ABSTRACT

The process of operating a reheating furnace for slabs involves the transport of slabs through the heating chamber of the furnace and contacting the slabs with a hot gaseous fluid which is supplied by one or more channels at a level below the path for the slabs. The fluid is thereby cooled and the cooled fluid is withdrawn to be readmitted into the channels subsequent to mixing with hot combustion products which are furnished by burners. The temperature of the fluid which is a mixture of cooled fluid and combustion products matches or approximates the optimum temperature for rolling of the slabs. That portion of the heating chamber which is adjacent to its inlet constitutes a magazine for temporary storage of slabs and contains ways for a charging machine which delivers slabs into the range of a walking-beam conveyor in the heating chamber.

18 Claims, 5 Drawing Figures

1
2
3
4
4'
5
6
7
8
9
10
11
12
13
15
16
17
18
20
21
23
24
25
26
27
28

PROCESS AND FURNACE FOR REHEATING METALLIC OBJECTS

CROSS-REFERENCE TO RELATED CASE

The reheating furnace of the present invention is somewhat similar to the furnace which is disclosed in the commonly owned copending U.S. patent application Ser. No. 785,776 filed Oct. 9, 1985 for "Process and furnace for reheating slabs, billets, blooms and the like".

BACKGROUND OF THE INVENTION

The present invention relates to a process for heating slabs, billets, blooms and like metallic objects, and to a furnace which can be utilized for the practice of the process. More particularly, the invention relates to improvements in reheating furnaces and to a process for treating metallic objects in such furnaces.

The trend in the steel industry is toward increased synchronization between continuous casting machines and rolling mill trains. This renders it possible to admit slabs, blooms, billets and like objects which issue from a continuous casting machine directly into a rolling mill train or to admit such objects into the reheating furnace in a condition in which they require a minimum of reheating, i.e., the temperature of each object should be relatively high at the time the object enters the reheating furnace. The result is a pronounced reduction of energy requirements for reheating of the objects prior to introduction into a rolling mill.

The above outlined prerequisites can be met only if the construction and mode of operation of a reheating furnace are attuned to the requirements of the machines which supply the objects as well as to the requirements of machines which process the objects subsequent to reheating. Thus, a modern reheating furnace should be capable of reheating cold objects as well as of merely increasing or reducing the temperature of an object which is delivered at a temperature below or at a temperature above the optimum rolling temperature, e.g., at a temperature between 1100° and 1260° C. In addition, a modern reheating furnace should be capable of storing a certain number of objects so as to take into account potential fluctuations in the output of a continuous casting machine and/or potential fluctuations in the requirements of a rolling mill train, i.e., of storing a certain number of objects when the output of the casting machine exceeds the requirements of the rolling mill train as well as of satisfying the requirements of the rolling mill train when the output of the casting machine drops below a standard value.

As a rule, a billet, a bloom or a slab must be heated primarily in the region which is adjacent to its external surface because the temperature of the cores of such objects deviates rather slightly from the optimum rolling temperature (it is normally between approximately 1100 ° and 1260° C.). Thus, only the stratum or strata which are close to the external surface of such an object are likely to undergo pronounced cooling during travel from the casting machine to the rolling mill train. For example, a slab comprises a core which constitutes the major portion of the slab and whose temperature is optimal for immediate rolling or such temperature even exceeds the optimal value so that only the relatively thin outer portion or stratum of the slab requires a reheating preparatory to admission into a rolling mill. The reheating furnace between the casting machine which turns out slabs and the rolling mill train must be designed with a view to ensure adequate heating of the outer stratum or strata of each slab but without overheating the core whose temperature already matches or very closely approximates the optimum rolling temperature.

OBJECTS AND SUMMARY OF THE INVENTION

An object of the invention is to provide a novel and improved process for reheating metallic objects in the form of billets, blooms, slabs and the like with minimal expenditures of energy and in such a way that the core of each object is not overheated prior to admission into a rolling mill.

Another object of the invention is to provide a process which renders it possible to utilize spent gaseous heating media for the reheating of objects on their way from a continuous casting machine to a rolling mill or to another processing machine.

A further object of the invention is to provide a novel and improved reheating furnace which can be utilized for the practice of the above outlined process.

An additional object of the invention is to provide a reheating furnace wherein the heating of slabs, billets, blooms and like objects can be carried out more economically than in heretofore known furnaces.

Still another object of the invention is to provide the reheating furnace with novel and improved means for heating the gaseous medium which is admitted into the heating chamber to come into contact with travelling metallic objects.

A further object of the invention is to provide a reheating furnace which is constructed and assembled in such a way that the temperature of the gaseous heating medium can be varied within a wide range to conform to the temperatures of transported objects.

Another object of the invention is to provide a reheating furnace which is of compact and relatively simple design but is capable of storing a substantial number of objects in the event of a breakdown of the processing machine (such as a rolling mill train) and which is capable of satisfying the requirements of the processing machine when the output of a casting machine or another source of metallic objects is below the anticipated output.

A further object of the invention is to provide the reheating furnace with novel and improved means for utilizing cooled gaseous media which issue from the heating chamber.

One feature of the invention resides in the provision of a process for heating blooms, billets, slabs and analogous metallic objects to a predetermined temperature in a reheating furnace wherein the objects are contacted by a heated gaseous fluid with attendant cooling of the fluid. The process comprises the steps of transporting the objects through the furnace, withdrawing the cooled fluid from the furnace, establishing and maintaining a mixing chamber, admitting into the mixing chamber variable quantities of the withdrawn cooled fluid, admitting into the mixing chamber a freshly heated gaseous fluid which is mixed with the admitted quantities of cooled fluid, maintaining the temperature of the resulting mixture at a value which is at least close to the predetermined temperature (e.g., by varying the quantity of admitted cooled gaseous fluid and/or by varying the quantity and/or the temperature of the freshly heated gaseous fluid), and causing the mixture to contact the objects in the furnace. The freshly heated gaseous fluid which is admitted into the mixing chamber can constitute combustion products which issue from one or more burners. The process can comprise the additional step of supplying some of the cooled gaseous fluid to the burner or burners. The temperature in the mixing chamber can be regulated in a simple way by changing the number of active burners and/or by changing the rate of admission of cooled gaseous fluid.

Some heat can be recovered from the cooled gaseous fluid before such fluid enters the mixing chamber. Alternatively, heat can be recovered from that fraction of the withdrawn cooled fluid which is not supplied into the mixing chamber.

The cooled fluid can be further cooled (if necessary) on its way to the mixing chamber (e.g., by exchanging heat with water or with another fluid).

Another feature of the invention resides in the provision of a furnace for reheating blooms, billets, slabs and analogous metallic objects to a predetermined temperature. The furnace comprises a casing or housing which can be said to constitute a means defining a heating chamber, a walking-beam conveyor or other suitable means for transporting objects through the chamber, means (e.g., one or more channels with ports or with otherwise configurated openings) for admitting a hot gaseous fluid into the chamber so that the fluid exchanges heat with the objects in the chamber and is thereby cooled, and means for supplying hot gaseous fluid to the admitting means. Such supplying means comprises means (e.g., the aforementioned casing) defining a mixing chamber, means (e.g., a conduit and a fan therein) for conveying a variable quantity of cooled gaseous fluid from the heating chamber into the mixing chamber, and at least one burner which is arranged to discharge into the mixing chamber hot gaseous combustion products so that the combustion products are mixed with the conveyed cooled gaseous fluid. The mixing chamber has one or more outlets for the flow of the resulting mixture to the supplying means.

A further feature of the invention resides in the provision of a reheating furnace for blooms, billets, slabs and analogous metallic objects. The furnace comprises means (such as the aforementioned casing) defining a heating chamber having an inlet and an outlet, means (such as the aforementioned walking-beam conveyor) for transporting a single file or several files of objects through the heating chamber from the inlet to the outlet, mobile charging means for delivering objects to the transporting means, and guide means defining for the charging means a path which has a discharge end disposed in a portion of the heating chamber in the region of the inlet. Such portion of the heating chamber can be said to constitute a magazine for temporary storage of objects therein. The furnace preferably further comprises means (e.g., a system of conveyors or the like) for removing treated objects from the transporting means (or for receiving treated objects from the transporting means) in the region of the outlet of the heating chamber. The guide means for the charging means is or can be cooled with water or with another fluid medium.

The furnace further comprises the aforediscussed means for admitting into the heating chamber a hot gaseous fluid which exchanges heat with the objects and is thereby cooled. The admitting means includes a mixing chamber in communication with the heating chamber (e.g., by way of one or more channels disposed below and extending transversely of the path of movement of objects from the inlet to the outlet of the heating chamber), a housing or other suitable means for withdrawing cooled gaseous fluid from the heating chamber (preferably in a region which is remote from the locus of admission of heated gaseous fluid into the heating chamber and is preferably adjacent to the inlet of the heating chamber), and means (such as the aforementioned conduit and one or more fans) for supplying variable quantities of cooled gaseous fluid from the withdrawing means to the mixing chamber. The admitting means further includes at least one burner which is arranged to discharge hot gaseous combustion products into the mixing chamber.

The furnace can further comprise means for cooling the cooled gaseous fluid in the conduit which connects the withdrawing means with the mixing chamber. The cooling means is preferably installed upstream of the fan or fans and is preferably operated only when the temperature of the cooled gaseous fluid flowing from the withdrawing means toward the mixing chamber exceeds a preselected value.

At least one auxiliary burner can be provided to admit hot gaseous combustion products directly into the heating chamber. Such auxiliary burner or burners can be installed in the upper portion of the casing so that the combustion products enter the heating chamber at a level above the path of advancement of objects from the inlet toward the outlet of the heating chamber.

The heating chamber can comprise a plurality of sections which may but need not be completely or substantially sealed from each other, and the furnace can further comprise means (such as the aforementioned channels) which can regulate the temperature of gaseous fluid in each of the sections at least substantially independently of the other section or sections. For example, each channel can be provided with a different number of openings in the form of ports or the like or each channel can be provided with differently dimensioned openings for admission of hot gaseous fluid into the respective section of the heating chamber. The regulating means further comprises means for supplying heating fluid to the channels. Such supplying means can include the aforementioned mixing chamber.

The sections of the heating chamber can be disposed one after the other, as considered in the direction of transport of objects from the inlet toward the outlet of the heating chamber and/or they may be disposed one after the other, as considered transversely of the direction of transport of objects by the walking-beam conveyor or by other suitable transporting means.

The novel features which are considered as characteristic of the invention are set forth in particular in the appended claims. The improved reheating furnace itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 illustrates the distribution of temperatures in a slab-shaped object which is about to be reheated in the furnace of FIGS. 1–3; and FIG. 5 is a fragmentary perspective view of the reheating furnace, substantially as seen in the direction of arrows from the line 5—5 of FIG. 2.

DESCRIPTION OF THE PREFERRED EMBODIMENTS

Figures 1, 2, 3:
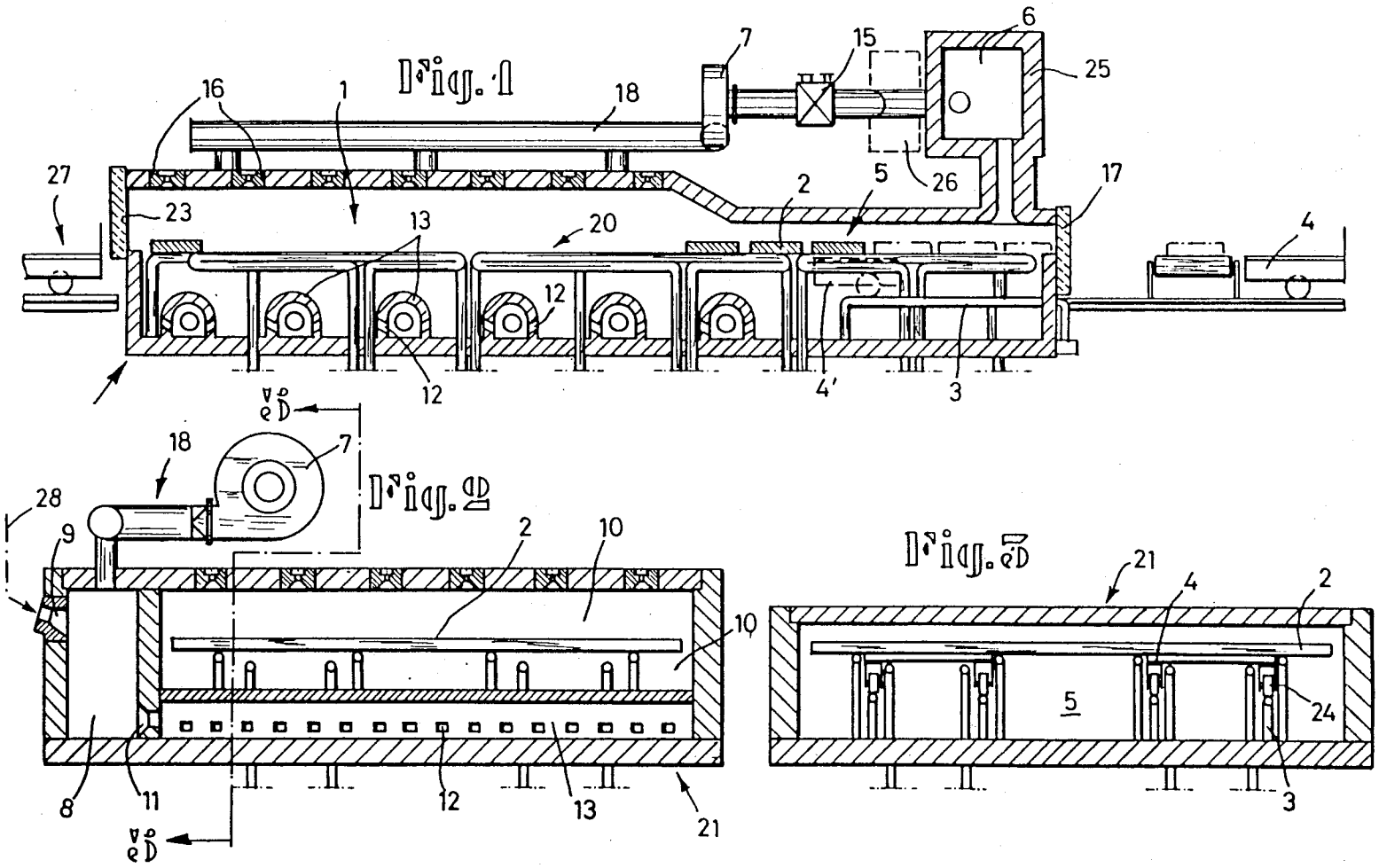
FIG. 1 is a fragmentary schematic longitudinal vertical sectional view of a reheating furnace which embodies one form of the present invention.
FIG. 2 is a transverse vertical sectional view of the reheating furnace which is shown in FIG. 1.
FIG. 3 is a transverse vertical sectional view of the magazine in the reheating furnace which is shown in FIGS. 1 and 2.
Figure 2:
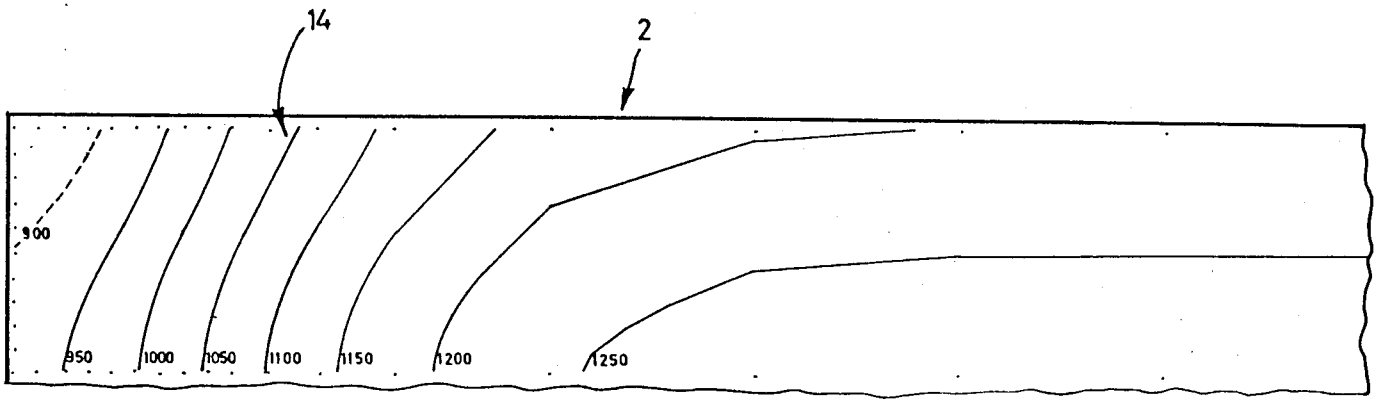
Figure 3A:
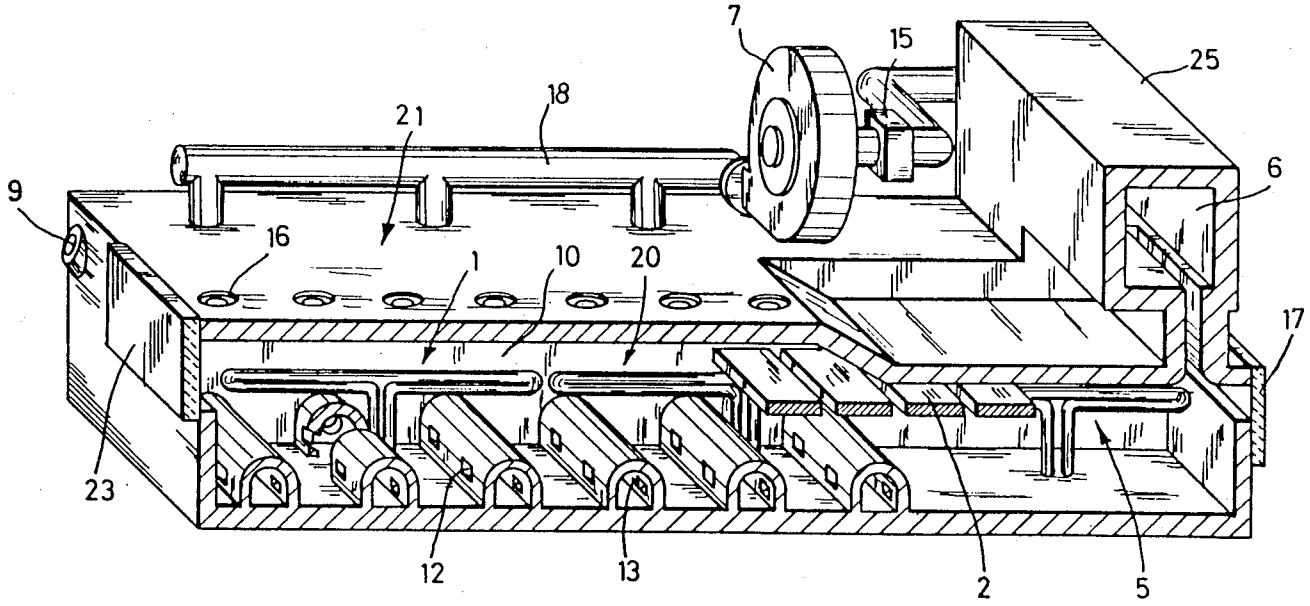

The reheating furnace which is shown in FIGS. 1, 2, 3 and 5 is equipped with a walking-beam conveyor 20 constituting a means for transporting slabs, blooms, billets or analogous metallic objects 2 through a heating chamber 1 which is defined by the walls of a casing 21. The reference character 4 denotes a charging or feeding machine which delivers objects 2 from a casting machine (not specifically shown) and which can enter the inlet of the heating chamber 1 by way of a normally closed first door or gate 17 so as to deliver the objects into a magazine 5 serving for temporary storage of a relatively large number of objects which are to be transported toward and beyond the outlet of the chamber 1, i.e., toward and beyond a normally closed second gate or door 23 at the downstream end of the casing 21.

The magazine 5 in the casing 21 contains elongated guide means or ways 3 which are preferably cooled with water and allow for entry of the charging machine 4 all the way to the position 4′ which is indicated in FIG. 1 by broken lines. For example, the dimensions of the magazine 5 can be selected in such a way that it can store a number of objects 2 matching that which is to be fed to the rolling mill train during a certain period of time (e.g., 30 minutes) or a number of objects matching or approximating 50 percent of the reference or average hourly output of the reheating furnace. The charging machine 4 is preferably mounted on wheels 24 so as to reduce the energy requirements of the prime mover which is used to reciprocate the charging machine along a predetermined path including that portion which is defined by the water-cooled guide means or ways 3. The feature that the charging machine 4 can deliver objects 2 directly into a portion of the heating chamber 1, namely into that portion of the heating chamber which is adjacent to the inlet (downstream of the first gate 17) renders it possible to greatly increase the capacity of the magazine 5 without unduly increasing the dimensions of the reheating furnace.

The casing 21 includes a rear portion which is adjacent to the gate 17 and supports at least one gas-withdrawing housing 25 defining a compartment 6 extending transversely of the direction of advancement of objects 2 from the gate 17 toward the gate 23 and communicating with the inlet of the chamber 1. The means for conveying a cooled gaseous fluid medium from the compartment 6 into a mixing chamber 8 in the casing 21 comprises a hot-gas fan 7 which causes cooled gaseous fluid to flow in a conduit 18 communicating with the compartment 6. The fan 7 is installed in the conduit 18 downstream of a recuperator 26 (indicated by broken lines) which serves to recover a certain amount of heat from the cooled gaseous fluid that is about to enter the mixing chamber 8. That portion of the conduit 18 which extends between the fan 7 and the compartment 6 can contain a cooling unit 15.

The mixing chamber 8 further receives a fresh gaseous fluid in the form of combustion products from several burners 9 which are installed in the casing 21. The mixing chamber 8 is adjacent to one side of the path along which the objects 2 are transported by the walking-beam conveyor 20 from the gate 17 toward the gate 23. The mixing chamber 8 has one or more outlets 11 for the hot gaseous fluid (constituting a mixture of the cooled gaseous fluid supplied by the fan 7 and of combustion products generated by the burners 9), and such outlet or outlets 11 deliver the gaseous fluid to several channels 13 which extend transversely of and below the path of movement of objects 2 in the chamber 1 and each of which has several rows of openings in the form of ports 12 serving to admit streams of gaseous fluid into the chamber 1, namely into that portion (10) of the chamber 1 which is located downstream of the magazine 5. The streams of gaseous fluid which issue from the openings or ports 12 are caused to contact and to heat the objects 2 which are on their way from the magazine 5 toward the gate 23.

The temperature of the gaseous fluid which issues via ports 12 is selected in such a way that it matches or approximates the optimum rolling temperature, i.e., that it is higher than the temperature of the relatively cool outer stratum or strata of each object 2 in the chamber portion 10 but does not appreciably deviate from the optimum temperature (e.g., 1250° C.) for the rolling of slabs or like metallic objects. The temperature of streams which are admitted via ports 12 can match or closely approximate the temperature of the core of each object 2 in the chamber portion 10. Such selection of the temperature of streams of hot gaseous fluid flowing through the ports 12 can be effected by regulating the ratio of cooled gaseous fluid which is supplied by the fan 7 (i.e., which is drawn from the compartment 6) and/or by regulating the percentage of combustion products which are supplied by the burners 9. At any rate, the temperature of the streams flowing through the ports 12 is selected with a view to ensure that the cores of the objects 2 are not overheated during transport from the gate 17 toward the gate 23, i.e., through the portion 10 of the heating chamber 1. For example, if the optimum rolling temperature is approximately 1250° C., the temperature of the gas streams flowing through the ports 12 on their way into the portion 10 of the heating chamber 1 can be in the range of 1260°–1270° C. This practically excludes an undesirable overheating of certain portions of the objects 2 which are being transported toward the gate 23. The length of the path between the magazine 5 and the gate 23 suffices to ensure adequate reheating of the outer strata of the objects to the optimum rolling temperature within an acceptable interval of time. The distribution of temperatures in the interior of a slab which is being transported from the magazine 5 and is about to be heated by streams issuing from the ports 12 of the channels 13 is shown in FIG. 4. The numerals adjacent to the isotherms 14 denote the temperatures (in °C.) of the corresponding strata of the slab 2. It can be seen that the temperature of the outer stratum of a slab 2 which is about to be contacted by streams of gaseous fluid entering the chamber portion 10 via ports 12 is substantially lower than the temperature of the core of the slab.

A portion of the machine which receives treated slabs 2 from the conveyor 20 is shown at 27.

The cooling unit 15 constitutes an optional but desirable feature of the improved reheating furnace. This unit constitutes a heat exchanger which can be operated with cool atmospheric air and is put to use only when the maximum temperature of the cooled gaseous fluid flowing from the compartment 6 toward the mixing chamber 8 exceeds a certain upper limit (e.g., 700° C.). Thus, the unit 15 constitutes a safety feature which prevents overheating of the mixture in the chamber 8 prior to admission of such mixture into the channels 13 and thence into the portion 10 of the heating chamber 1.

It is possible to provide the improved reheating furnace with two or more compartments 6 which are preferably disposed next to each other and extend transversely of the casing 21 at a level above the inlet (i.e., above the magazine 5). One of the compartments 6 can supply cooled gaseous fluid to the intake of the fan 7 and another compartment 6 can be used to supply cooled gaseous fluid medium to a recuperator (corresponding to the recuperator 26) and/or to the flue (not shown).

The improved reheating furnace can be used with equal or similar advantage for the reheating of cold or partially cooled (medium hot) objects. The lower furnace then receives a hot gaseous fluid medium from the channels 13. The operation of the fan 7 is then regulated (or the conduit 18 contains a flow restrictor) so as to ensure that the quantity of cooled gaseous fluid which flows from the compartment 6 to the mixing chamber 8 is reduced or that the flow of such cooled gaseous fluid is interrupted in order to avoid a cooling of hot combustion products which are generated by the burners 9. This ensures that the channels 13 receive the gaseous fluid at an elevated temperature in order to ensure rapid heating of cold or medium hot objects in the chamber 1.

FIG. 1 shows additional or auxiliary burners 16 which are provided in the top wall or walls (superstructure) of the casing 21 and can be turned on when necessary in order to increase the output of the reheating furnace, either when the furnace is to reheat relatively hot objects or when the furnace is to heat relatively cold or medium hot objects.

The burners 9 and/or 16 can receive cooled gaseous fluid from the compartment 6 (a conduit which can deliver such fluid to the burners 9 is indicated by a phantom line 28). However, as a rule, the requirements of the burners 9 and/or 16 are satisfied by a source other than the illustrated compartment 6.

The improved reheating furnace exhibits the advantage that the admission of the cool gaseous fluid from the compartment 6 into the mixing chamber 8 entails a considerable reduction of the normal combustion temperature of fuel which is supplied to the burners 9 to be converted into combustion products which are thereupon mixed with the gaseous fluid entering the mixing chamber 8 via conduit 18. Furthermore, the quantity of undesirable NO products is reduced by approximately 50 percent. This is particularly important in countries or states which strictly enforce all rules and laws pertaining to the permissible percentages of $NO_x$ products in the atmosphere. The cost of adhering to such rules is but a fraction of the cost in connection with the operation of conventional reheating furnaces which do not employ cooled gaseous fluids for readmission into the heating chamber.

As a rule, only approximately 10 percent of each object 2 in the chamber 1 must be reheated (see FIG. 4), i.e., the temperature of the major part of each object which enters the chamber 1 is sufficiently high for a rolling without any reheating. However, and as mentioned above, the improved furnace can be used with equal or similar advantage for the reheating of medium hot or medium cold objects (whose temperature is in the range between 400° and 1100° C.). For example, the furnace can be used for the reheating of objects whose cores are relatively hot (with a temperature of between 1100° and 1260° C.) and whose outer strata are much colder (with a temperature of between, for example, 400° and 1100° C.).

The portion 10 of the heating chamber 1 can be said to comprise a plurality of sections each of which contains one or more channels 13. These channels serve to regulate the temperature of hot gases in the respective sections of the portion 10, e.g., by admitting streams of hot gaseous fluid through different numbers of openings or ports 12 and/or by admitting streams of hot gaseous fluid through ports which are smaller or larger than in the other channels. In the illustrated furnace, the sections of the portion 10 of the heating chamber 1 are disposed one after the other, as considered in the direction of transport of objects 2 from the inlet (gate 17) toward the outlet (gate 23) of the heating chamber 1. However, it is equally possible to provide two or more sections which form one or more rows extending transversely of the direction of travel of objects from the gate 17 (and more specifically from the magazine 5) toward the gate 23. The sections of the portion 10 can be partially or nearly completely sealed from each other. Alternatively, and as shown in FIG. 1, such sections can be said to constitute parts of a single chamber portion 10 which differ from one another in that the temperature of hot gaseous fluid therein is different from the temperature prevailing in the other section or sections.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A process for heating blooms, billets, slabs and analogous metallic objects to a predetermined temperature in a reheating furnace wherein the objects are contacted by a heated gaseous fluid with attendant cooling of the fluid, comprising the steps of transporting the objects through the furnace; withdrawing the cooled fluid from the furnace; establishing and maintaining a mixing chamber; admitting into the mixing chamber variable quantities of the withdrawn cooled fluid; admitting into the mixing chamber a freshly heated gaseous fluid which is mixed with the admitted quantities of cooled fluid; maintaining the temperature of the resulting mixture at a value which is at least close to said predetermined temperature; and causing such mixture to contact the objects in the furnace.

2. The process of claim 1, wherein the freshly heated gaseous fluid which is admitted into the mixing chamber is heated by burners, and further comprising the step of supplying some of the withdrawn cooled fluid to such burners.

3. The process of claim 1, further comprising the step of recovering some heat from the withdrawn cooled fluid prior to admission of said variable quantities of cooled fluid into the mixing chamber.

4. The process of claim 1, further comprising the step of recovering heat from that fraction of withdrawn cooled fluid which is not admitted into the mixing chamber.

5. A furnace for reheating blooms, slabs, billets and analogous metallic objects to a predetermined temperature, comprising means defining a heating chamber; means for transporting objects through said chamber; means for admitting a hot gaseous fluid into said chamber so that the fluid exchanges heat with the objects and is thereby cooled; and means for supplying hot gaseous fluid to said admitting means, including means defining a mixing chamber, means for conveying a variable quantity of cooled gaseous fluid from said heating chamber into said mixing chamber, and at least one burner arranged to discharge hot gaseous combustion products into said mixing chamber wherein the combustion products are mixed with cooled gaseous fluid, said mixing chamber having at least one outlet which delivers the resulting mixture to said supplying means.

6. A reheating furnace for blooms, slabs, billets and analogous metallic objects, comprising means defining a heating chamber having an inlet and an outlet; means for transporting objects through said chamber from said inlet to said outlet; mobile charging means for delivering objects to said transporting means; guide means defining for said charging means a path which has a discharge end disposed in a portion of said chamber in the region of said inlet, said portion of said chamber constituting a magazine for temporary storage of objects therein; and means for admitting into said chamber a hot gaseous fluid which exchanges heat with the objects to be thereby cooled, said admitting means including a mixing chamber in communication with said heating chamber, means for withdrawing cooled gaseous fluid from said heating chamber, and means for supplying variable quantities of cooled gaseous fluid from said withdrawing means to said mixing chamber.

7. The furnace of claim 6, further comprising means for removing objects from said transporting means in the region of said outlet.

8. The furnace of claim 6, wherein said guide means is cooled with water.

9. The furnace of claim 6, further comprising means for admitting into said chamber a hot gaseous fluid which exchanges heat with the objects and is thereby cooled, said admitting means including a mixing chamber in communication with said heating chamber, means for withdrawing cooled gaseous fluid from said heating chamber, and means for supplying variable quantities of cooled gaseous fluid from said withdrawing means to said mixing chamber.

10. The furnace of claim 6, wherein said admitting means further comprises at least one burner arranged to discharge hot combustion products into said mixing chamber.

11. The furnace of claim 6, wherein said supplying means comprises a conduit connecting said withdrawing means with said mixing chamber, at least one fan in said conduit, and means for cooling the gaseous fluid in said conduit intermediate said fan and said withdrawing means.

12. The furnace of claim 11, wherein said cooling means is arranged to cool the gaseous fluid in said conduit only when the temperature of such fluid reaches a predetermined value.

13. The furnace of claim 6, further comprising at least one burner arranged to discharge hot combustion products directly into said heating chamber.

14. The furnace of claim 13, wherein said heating chamber is defined by a casing having a portion disposed above said chamber and said burner is installed in said portion of the casing.

15. The furnace of claim 6, wherein said chamber includes a plurality of sections and further comprising means for regulating the temperature of gaseous fluid in each of said sections independently of the other section or sections.

16. The furnace of claim 15, wherein said regulating means comprises at least one channel for each of said sections, said channels having openings for admission of gaseous heating fluid into the respective sections and said regulating means further comprising means for supplying heating fluid to said channels.

17. The furnace of claim 15, wherein said sections are disposed one after the other, as considered in the direction of transport of objects from said inlet toward said outlet.

18. The furnace of claim 15, wherein said sections are disposed next to each other, as considered transversely of the direction of transport of objects from the inlet toward the outlet of said chamber.

* * * * *